US010830452B2

(12) United States Patent
Gottsov et al.

(10) Patent No.: US 10,830,452 B2
(45) Date of Patent: Nov. 10, 2020

(54) APPLIANCE AND METHODS FOR OPERATING SAME IN A SAFETY-CRITICAL OPERATION USING A TOUCHSCREEN

(71) Applicant: Haier US Appliance Solutions, Inc., Wilmington, DE (US)

(72) Inventors: Alex Gottsov, Louisville, KY (US); Steven Michael Recio, Louisville, KY (US); Craig Edward Wicke, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 259 days.

(21) Appl. No.: 16/024,974

(22) Filed: Jul. 2, 2018

(65) Prior Publication Data

US 2020/0003425 A1 Jan. 2, 2020

(51) Int. Cl.

| | |
|---|---|
| ***H05B 1/02*** | (2006.01) |
| ***F24C 7/08*** | (2006.01) |
| ***F24C 15/02*** | (2006.01) |
| ***F24C 14/00*** | (2006.01) |

(52) U.S. Cl.

CPC ..... *F24C 7/085* (2013.01); *F24C 14/00* (2013.01); *F24C 15/022* (2013.01)

(58) Field of Classification Search

CPC ..... F24C 7/085; F24C 14/00; F24C 15/022; H05B 1/02; H05B 1/0253; H05B 3/0076

USPC ..... 219/506, 494, 497, 412–414, 481

See application file for complete search history.

(56) References Cited

U.S. PATENT DOCUMENTS

| | | | | |
|---|---|---|---|---|
| 4,369,352 | A * | 1/1983 | Bowles | F24C 14/02 219/395 |
| 5,534,678 | A | 7/1996 | Bowles et al. | |
| 6,112,135 | A * | 8/2000 | Peterson | G05B 9/02 700/209 |
| 6,750,433 | B2 | 6/2004 | Guenther et al. | |
| 2007/0158335 | A1 * | 7/2007 | Mansbery | F24C 7/082 219/505 |
| 2016/0076777 | A1 | 3/2016 | Wait | |
| 2017/0000292 | A1 | 1/2017 | Park et al. | |

FOREIGN PATENT DOCUMENTS

| | | |
|---|---|---|
| CN | 105747894 | 7/2016 |
| CN | 107077267 | 8/2017 |
| CN | 107366128 | 11/2017 |
| DE | 102013017202 A1 | 4/2015 |

OTHER PUBLICATIONS

International Search Report, PCT Application No. PCT/CN2019/094357, dated Sep. 29, 2019, 2 Pages.

Chris Shaw, ARM9 micro enables support for home appliance safety standards, New Electronics, New Electronics, http://www.newelectronics.co.uk/electronics-news-arm9-micro-enables-support-for-home-appliance-safety-standards/21916/ Jan. 14, 2010, 2 pages.

LG, Cleaning, care and maintenance, http://www.lg.com/us/support/answers/ranges2015/electric/cleaning-maintenance 2015, 4 pages.

* cited by examiner

*Primary Examiner* — Mark H Paschall

(74) *Attorney, Agent, or Firm* — Dority & Manning, P.A.

(57) ABSTRACT

An appliance and methods for operating the appliance in a safety-critical operation are provided. The appliance and methods for operating the appliance include features that provide safe and intuitive ways to initiate and cancel safety-critical operations performed by the appliance.

12 Claims, 9 Drawing Sheets

APPLIANCE AND METHODS FOR OPERATING SAME IN A SAFETY-CRITICAL OPERATION USING A TOUCHSCREEN

FIELD OF THE INVENTION

The subject matter of the present disclosure relates generally to appliances and methods for operating such appliances in a safety-critical operation using a touchscreen, such as an oven appliance in a self-cleaning cycle.

BACKGROUND OF THE INVENTION

Consumer appliances configured to perform safety-critical operations are required to meet certain industry safety standards. For instance, oven appliances configured to perform self-cleaning cycles are required to have a minimum of two distinct steps to initiate the cycle. Further, to stop a self-cleaning cycle, such oven appliances are required to have a single step means to cancel the cycle. Such requirements are mandated by various standards, including UL858, set by Underwriters Laboratories (UL). Moreover, generally, at least one computing device managing such operations must be UL 60730 Class B compliant. That is, the computing device must have the ability to investigate single order failure faults, e.g., for control functions and software executable on the computing device.

Conventional appliances have relied on multiple static keys to meet the two-step industry standards. This may make the design less appealing, more costly and space consuming, and the computing device must manage all of the different static keys. Some appliances integrate static keys with touchscreens. Such touchscreens are typically managed by a microprocessor running a high-level operating system. Such microprocessors are generally not UL 60730 Class B compliant. Thus, it has been a challenge for appliances having touchscreens to meet industry standards.

Accordingly, an oven appliance and methods therefore that address one or more of the challenges noted above would be useful.

BRIEF DESCRIPTION OF THE INVENTION

Aspects and advantages of the invention will be set forth in part in the following description, may be apparent from the description, or may be learned through practice of the invention.

In one exemplary embodiment, an appliance is provided. The appliance includes one or more operational components configured to perform a safety-critical operation. Further, the appliance includes a control system for operating the appliance in the safety-critical operation. The control system includes a main controller and a touchscreen assembly. The touchscreen assembly includes a touchscreen configured for receiving touch inputs to the touchscreen. The touchscreen assembly also includes a touchscreen controller communicatively coupled with the main controller and configured to detect a location of the touch inputs to the touchscreen. Further, the touchscreen assembly includes a display for presenting one or more indicia. In addition, the touchscreen assembly includes a microprocessor communicatively coupled with the main controller, the touchscreen controller, and the display, the microprocessor configured to drive the one or more indicia of the display. In such embodiments, the main controller is configured to: receive, from the touchscreen controller and in response to a touch input to the touchscreen, a location of the touch input to the touchscreen; determine whether the location of the touch input corresponds with a predetermined location associated with initiating the safety-critical operation; receive, from the microprocessor, an activation request to commence the safety-critical operation; and activate the one or more operational components to commence the safety-critical operation if the main controller receives the activation request and the location of the touch input corresponds with the predetermined location.

In another exemplary embodiment, a method for operating an appliance in a safety-critical operation is provided. The method includes receiving, on a touchscreen of a touchscreen assembly, a first touch input. The method also includes receiving, by a main controller communicatively coupled with a microprocessor and a touchscreen controller, a location of the first touch input on the touchscreen from the touchscreen controller. Further, the method includes determining, by the main controller, whether the location of the first touch input corresponds with a first predetermined location associated with initiating the safety-critical operation. Moreover, the method includes receiving, by a microprocessor communicatively coupled with the main controller and a display of the touchscreen assembly, the location of the first touch input on the touchscreen from the touchscreen controller. In addition, the method includes determining, by the microprocessor, whether the location of the first touch input corresponds with the first predetermined location associated with initiating the safety-critical operation. The method also includes receiving, on the touchscreen, a second touch input. Further, the method includes receiving, by the main controller, a location of the second touch input on the touchscreen from the touchscreen controller. In addition, the method includes determining, by the main controller, whether the location of the second touch input corresponds with a second predetermined location associated with initiating the safety-critical operation. Moreover, the method includes releasing, by the main controller, an interlock if the main controller determines that the location of the first touch input corresponds with the first location and the location of the second touch input corresponds with the second location associated with initiating the safety-critical operation. The method further includes receiving, by the microprocessor, the location of the second touch input on the touchscreen from the touchscreen controller. The method also includes determining, by the microprocessor, whether the location of the second touch input corresponds with the second predetermined location associated with initiating the safety-critical operation. In addition, the method includes receiving, at the main controller, an activation request from the microprocessor to commence the safety-critical operation if the location of the first touch input corresponds with the first predetermined location and the location of the second touch input corresponds with the second predetermined location associated with initiating the safety-critical operation. The method additionally includes activating, by the main controller, one or more operational components to commence the safety-critical operation if the main controller receives the activation request and the interlock is released.

In yet another exemplary embodiment, an appliance is provided. The appliance includes one or more operational components configured to perform a safety-critical operation. The appliance also includes a control system for operating the appliance in the safety-critical operation. The control system includes a main controller and a touchscreen configured for receiving one or more touch inputs to the touchscreen. The control system also includes a touchscreen controller communicatively coupled with the main controller and configured to detect the one or more touch inputs to the touchscreen, wherein the touchscreen controller is UL 60730 Class B compliant. Further, the control system includes a display for presenting one or more indicia. In addition, the control system includes a microprocessor communicatively coupled with the main controller, the touchscreen controller, and the display. The microprocessor is configured to drive the one or more indicia of the display. The main controller is configured to: operate the appliance in the safety-critical operation for a predetermined run time; receive, during operation of the appliance in the safety-critical operation for the predetermined run time, a cancel touch input to any location on the touchscreen from the touchscreen controller; and cancel the safety-critical operation based on the cancel touch input on the touchscreen.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
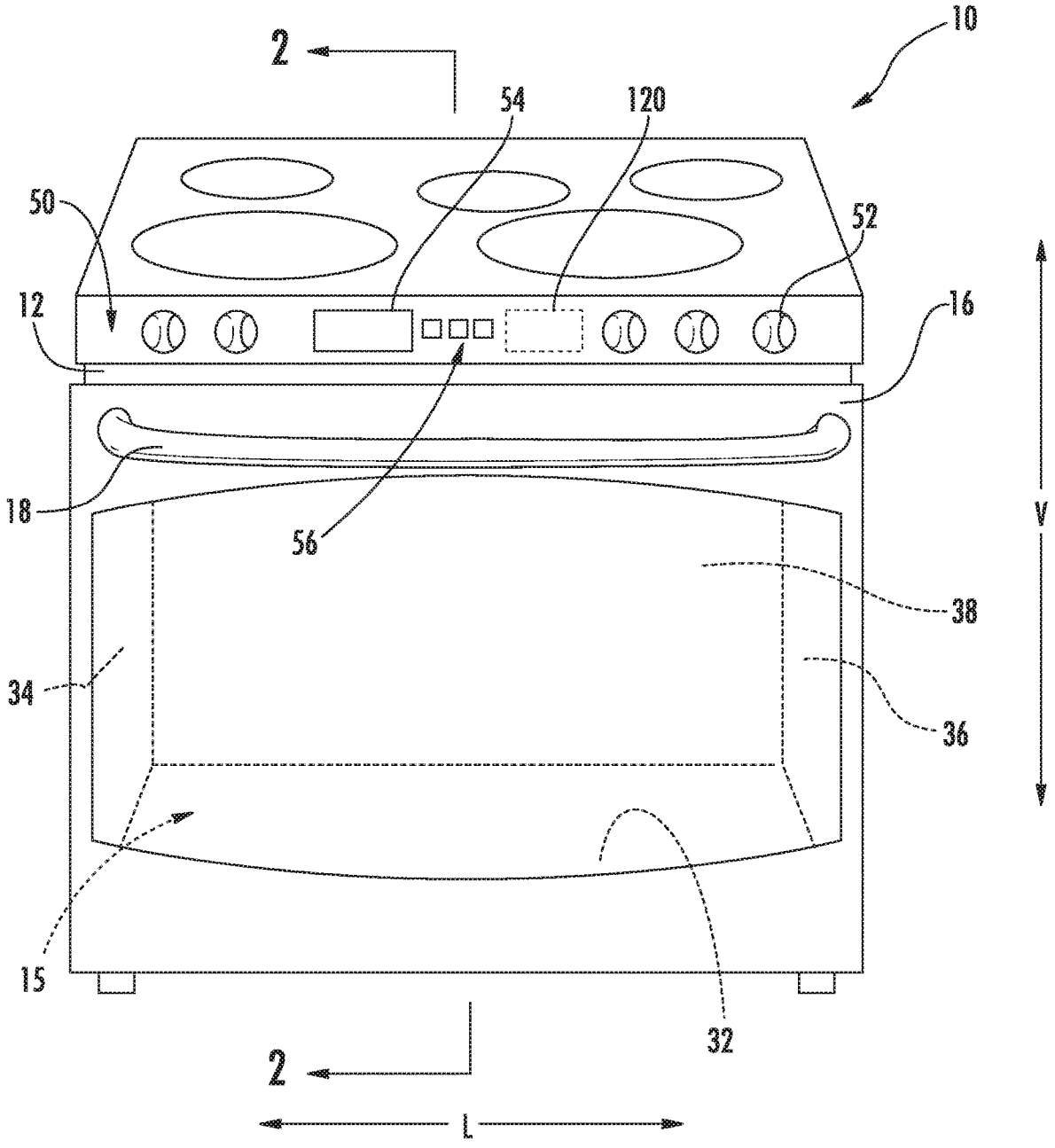
FIG. 1 provides a front perspective view of an oven appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
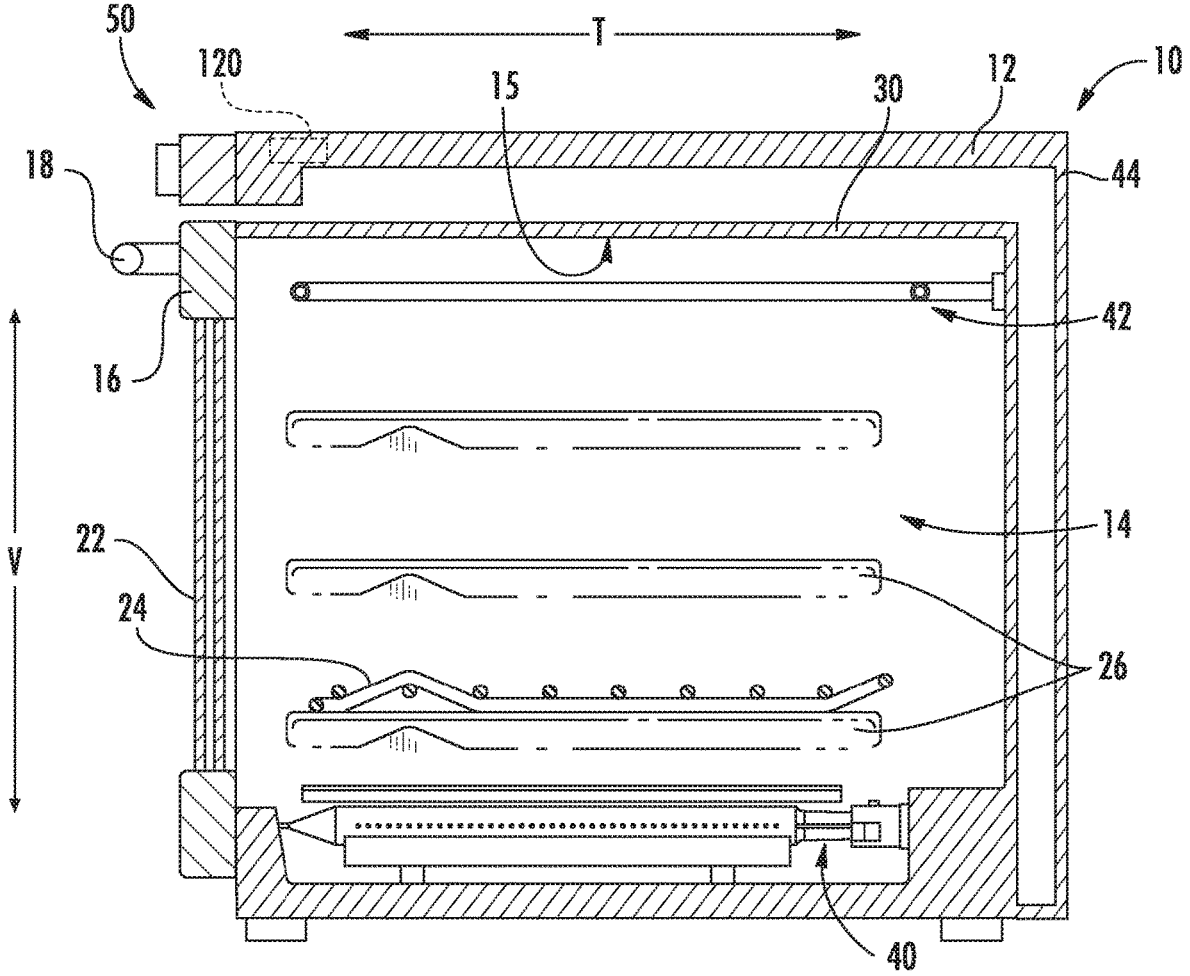
FIG. 2 provides a cross-sectional view of the example oven appliance of FIG. 1 taken along line 2-2 of FIG. 1.

FIGS. 1 and 2 provide various views of an exemplary oven appliance 10 according to exemplary embodiments of the present disclosure. In particular, FIG. 1 provides a front perspective view of oven appliance 10 and FIG. 2 provides a cross-sectional view of oven appliance 10 taken along line 2-2 of FIG. 1. As depicted, oven appliance 10 defines a vertical direction V, a lateral direction L, and a transverse direction T. The vertical direction V, lateral direction L, and transverse direction T are mutually perpendicular and form an orthogonal direction system. As will be understood, oven appliance 10 is provided by way of example only and that the present subject matter may be incorporated into any suitable appliance. Thus, the present subject matter may be used with other oven or range appliance configurations, e.g., that define multiple interior cavities for the receipt of food and/or having different configuration than what is shown in FIGS. 1 and 2. The present subject matter may be incorporated into other suitable types of appliances as well that are configured to perform safety-critical operations, such as e.g., cooktop appliances, dryers, washing machines, microwaves, etc.

Oven appliance 10 includes an insulated cabinet 12 that defines an oven cavity, such as a cooking chamber 14 (FIG. 2). More particularly, cooking chamber 14 is defined by various interior surfaces 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access opening 20 to cooking chamber 14. For example, a user can pull on handle 18 to open or close door 16 and access cooking chamber 14 through opening 20.

Oven appliance 10 can include one or more seals (not shown) between door 16 and cabinet 12 that assist with maintaining heat and cooking fumes within cooking chamber 14 when door 16 is closed as shown in FIG. 2. Multiple parallel glass panes 22 (FIG. 2) provide for viewing the contents of cooking chamber 14 when door 16 is closed and assist with insulating cooking chamber 14. A baking rack 24 is positioned in cooking chamber 14 for the receipt of one or more food items and/or utensils containing food items. Baking rack 24 is slidably received onto embossed ribs 26 or sliding rails such that rack 24 may be conveniently moved into and out of cooking chamber 14 when door 16 is open.

As shown, various sidewalls of cabinet 12 define cooking chamber 14. For this embodiment, cooking chamber 14 includes a top wall 30 (FIG. 2) and a bottom wall 32 (FIG. 1) which are spaced apart along the vertical direction V. Left sidewall 34 and right sidewall 36 (as defined according to a front view as shown in FIG. 1) extend between and connect top wall 30 and bottom wall 32 and are spaced apart along the lateral direction L. A rear wall 38 (FIG. 1) extends between the top wall 30 and bottom wall 32 as well as between the left sidewall 34 and right sidewall 36 and is spaced apart from door 16 along the transverse direction T. Cooking chamber 14 is thus defined between top wall 30, bottom wall 32, left sidewall 34, right sidewall 36, and rear wall 38.

As shown particularly in FIG. 2, for this embodiment, a gas fueled or electric bottom heating element 40 (e.g., a gas burner or an electric heating element) is positioned in cabinet 12, e.g., at a bottom portion of cabinet 12. Bottom heating element 40 may be used to heat cooking chamber 14 for both cooking and cleaning of oven appliance 10. For instance, heating element 40 may be used to heat cooking chamber 14 for a self-cleaning cycle. The size and heat output of bottom heating element 40 can be selected based on the e.g., the size of oven appliance 10.

A top heating element 42 is positioned in cooking chamber 14 of cabinet 12, e.g., at a top portion of cabinet 12. Top heating element 42 may be used to heat cooking chamber 14 for both cooking/broiling and cleaning cycles of oven appliance 10. Like bottom heating element 40, the size and heat output of top heating element 42 can be selected based on the e.g., the size of oven appliance 10. In the example embodiment shown in FIG. 2, top heating element 42 is shown as an electric resistance heating element. However, in alternative embodiments, a gas, microwave, halogen, or any other suitable heating element may be used instead of electric resistance heating element 42.

As shown best in FIG. 1, oven appliance 10 includes a user interface panel 50. User interface panel 50 may include various input controls, such as one or more of a variety of electrical, mechanical or electro-mechanical input devices. The controls may include rotary dials, push buttons, touchpads, and touchscreens, for example. For this embodiment, user interface panel 50 includes a plurality of control knobs 52 (e.g., for operating the burner assemblies of range appliance of oven appliance 10), a touchscreen assembly 54, and one or more discrete keys 56. Touchscreen assembly 54 may include any suitable type of touchscreen. For instance, touchscreen assembly 54 may be a resistive, capacitive, surface acoustic wave, infrared, optical imaging, or an acoustic pulse recognition touchscreen. In some embodiments, touchscreen assembly 54 includes a liquid crystal display (LCD) with one of the example touchscreens noted above. The one or more discrete keys 56 may be touch sensitive controls, such as electronic pushbuttons. A main controller 120, which will be described in further detail herein, is communicatively coupled with the various controls of user interface panel 50 through which a user may select various operational features and modes and monitor progress of oven appliance 10. Additionally, one or more controls of oven appliance 10 may communicate with main controller 120 to start a safety-critical operation, such as e.g., a self-clean cycle.

Figure 3:
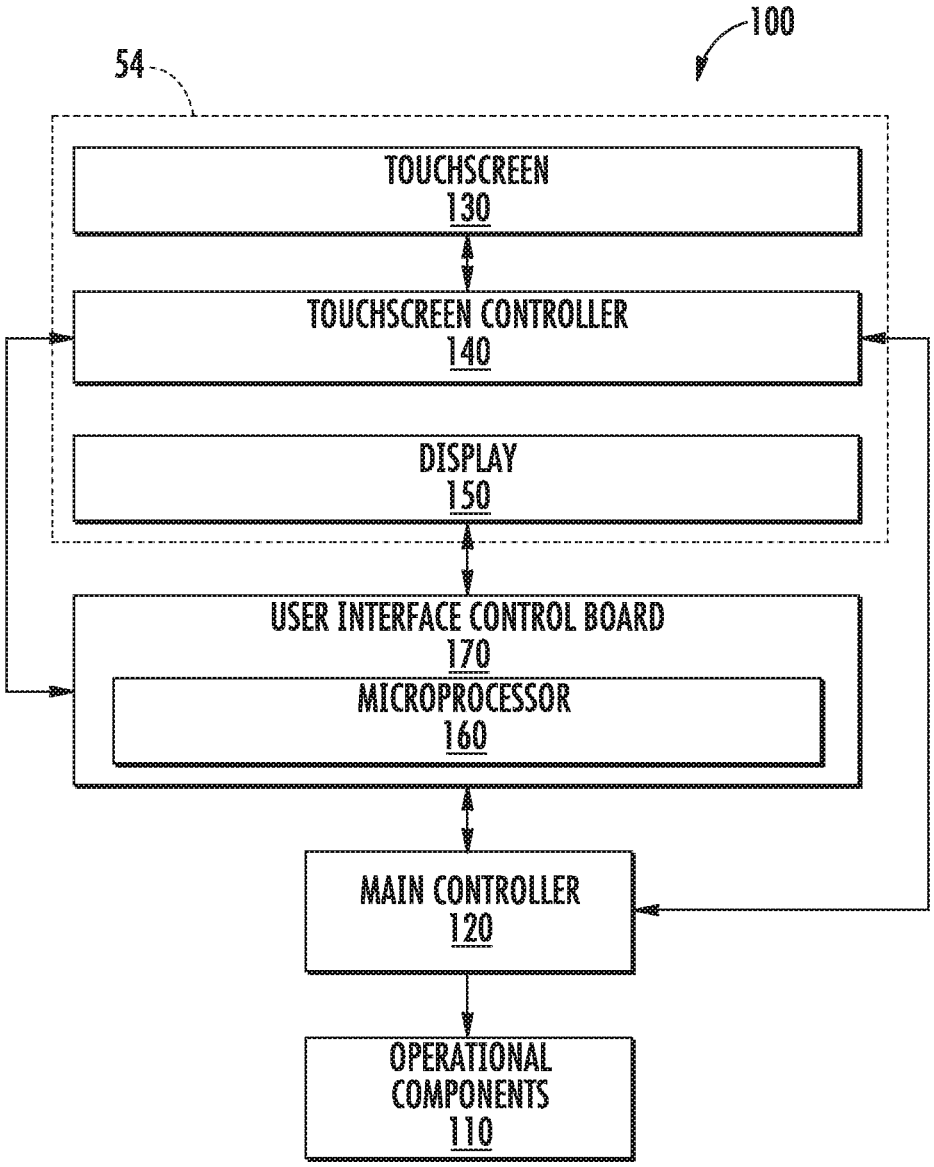
FIG. 3 provides a block diagram of an exemplary control system of the oven appliance of FIGS. 1 and 2.

FIG. 3 provides a block diagram of an exemplary control system 100 for operating oven appliance 10 of FIGS. 1 and 2 in a safety-critical operation. However, it will be appreciated that the control system 100 depicted in FIG. 3 and described below may be incorporated into other suitable appliances, e.g., cooktop appliances, microwaves, etc.

As shown in FIG. 3, control system 100 includes main controller 120. Generally, main controller 120 is configured for operating oven appliance 10. For instance, main controller 120 may be configured to control one or more operational components 110 of oven appliance 10. Example operational components may include one or more of heating elements 40, 42 (FIG. 2). Main controller 120 may control at least one operation of heating elements 40 and 42, e.g., to perform a self-cleaning cycle. Main controller 120 is communicatively coupled with the one or more operational components 110. For instance, main controller 120 may be in communication via a suitable wired or wireless connection with heating element 40, heating element 42, the controls of user interface panel 50, temperature sensing devices, and/or other suitable components of oven appliance 10.

In some example embodiments, main controller 120 may include one or more memory devices and one or more processing devices, such as general or special purpose microprocessors operable to execute programming instructions or micro-control code associated with operating oven appliance 10. The memory device (i.e., memory) may represent random access memory, such as e.g., DRAM, or read only memory such as ROM or FLASH. In some embodiments, the one or more processing devices execute programming instructions stored in memory. The memory may be a separate component from the processor or may be included onboard within the processor. The memory can store information accessible to processing device, including instructions that can be executed by processing device. Optionally, the instructions can be software or any set of instructions that, when executed by the processing device, cause the one or more processing devices to perform operations. For certain embodiments, the instructions include a software package configured to operate oven appliance 10 and interpret one or more electrical signals. For example, the instructions may include a software package configured to execute commands based on feedback from user controls as described more fully below.

Main controller 120 may be positioned in a variety of locations throughout oven appliance 10. As illustrated in FIG. 2, main controller 120 may be located proximate user interface panel 50 of oven appliance 10. In such embodiments, input/output ("I/O") signals may be routed between main controller 120 and various operational components 110 of oven appliance 10, such as heating element 40, heating element 42, various controls of user interface panel 50, sensors, alarms, and/or other components as may be provided. For instance, signals may be directed along one or more wiring harnesses that may be routed through cabinet 12.

Figure 4:
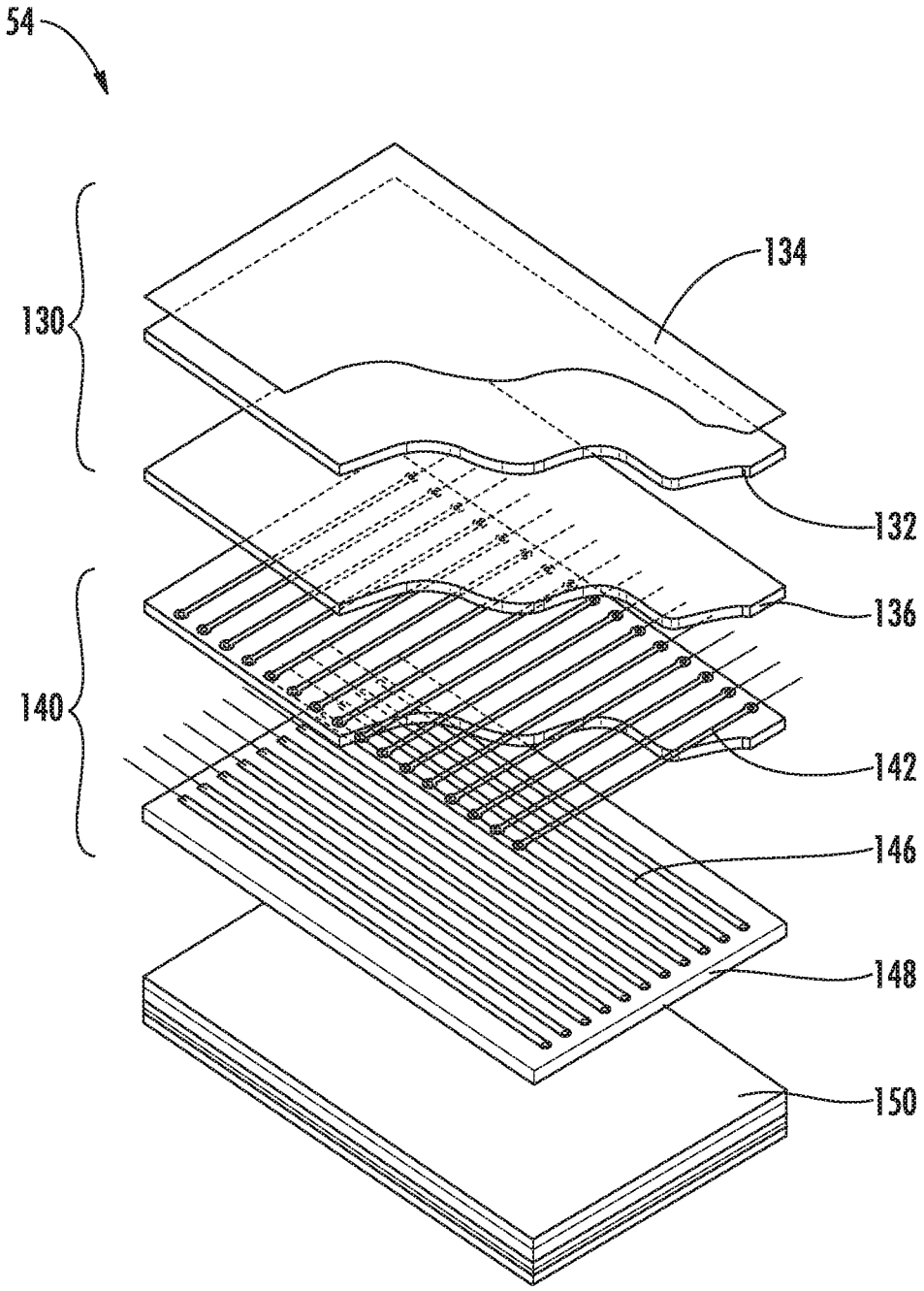
FIG. 4 provides an exploded view of an exemplary touchscreen assembly according to example embodiments of the present disclosure.

FIG. 4 provides an exploded view of exemplary touchscreen assembly 54 of user interface panel 50. For this exemplary embodiment, touchscreen assembly 54 is a mutual capacitance touchscreen assembly. As shown, touchscreen assembly 54 includes a touchscreen 130, a touchscreen controller 140, and a display 150. Touchscreen 130 includes a touch-sensitive screen 132. Touch-sensitive screen 132 has a layer formed of a capacitive material and has an anti-reflective coating 134. A bonding layer 136 bonds touch-sensitive screen 132 of touchscreen 130 to the components of touchscreen controller 140. As depicted, touchscreen controller 140 includes capacitor driving lines 142 adhered to an insulating layer 144 and capacitor sensing lines 146 adhered to a glass substrate 148. The driving lines 142 carry current and the sensing lines 146 detect current at nodes of the sensing lines 146, e.g., when a touch input is provided to touchscreen 130. Sensing lines 146 are oriented orthogonal to driving lines 142 to form a coordinate system. Every point or location on the driving-sensing line grid generates its own signal when a touch input is provided to touchscreen 130. Touchscreen controller 140 relays the one or more signals indicative of the location of the touch input to touchscreen 130 to a microprocessor 160 and main controller 120, e.g., as electrical impulses. Each of the layers are generally transparent so that display 150 may present one or more indicia or graphics to a user, e.g., start cycle, cancel cycle, time remaining indicia.

Further, touchscreen controller 140 may include one or more processor(s) and associated memory device(s) configured to perform a variety of computer-implemented functions and/or instructions (e.g., performing the methods, steps, calculations and the like and storing relevant data as disclosed herein). The instructions when executed by the processor(s) can cause the processor(s) to perform operations according to the present disclosure. Further, the touchscreen controller 140 may include one or more input/output port(s) to interface touchscreen controller 140 with main controller 120.

For this embodiment, touchscreen controller 140 is UL 60730 Class B compliant. That is, touchscreen controller 140 is relied upon for safety of operating oven appliance 10. As touchscreen controller 140 is Class B compliant, touchscreen controller 140 may sense a malfunction and influence main controller 120 to switch oven appliance 10 "off". For instance, touchscreen controller 140 may include instructions that, when executed, cause the processor(s) to perform self-test operations of the hardware and critical functions of touchscreen controller 140. Such self-test operations may be performed at predetermined intervals. touchscreen controller 140 may be communicatively coupled with a watchdog timer external to touchscreen controller 140 to trigger or initiate the self-test operations at the predetermined interval. Additionally or alternatively, touchscreen controller 140 may include at least two oscillators. One oscillator may be used to detect locations of touch inputs to touchscreen 130 and to route user feedback to main controller 120 and microprocessor 160. The other oscillator may be used to supply an independent timer for the periodic self-test operations.

As further depicted in FIG. 3, control system 100 includes microprocessor 160 connected to a user interface control board 170. User interface control board 170 houses microprocessor 160 along with other electronic components. Generally, microprocessor 160 is configured to run a high-level operating system for processing inputs from various controls of user interface panel 50, and in some instances, driving the controls to provide user feedback. Microprocessor 160 receives signals from touchscreen controller 140 indicative of the location of the various touch inputs to touchscreen 130 and changes the images or indicia on display 150 of touchscreen assembly 54 accordingly. User interface control board 170 is communicatively coupled with touchscreen controller 140 of touchscreen assembly 54 and main controller 120, e.g., via any suitable wired or wireless connection. For this embodiment, microprocessor 160 is UL 60730 Class A compliant. That is, microprocessor 160 is not Class B compliant and thus is not relied upon for the safety of oven appliance 10.

Generally, the various features of control system 100 of oven appliance 10 enable safety-critical operations to be initiated and canceled with dynamic controls whilst complying with industry standards, such as UL858, and having control features that are UL 60730 Class B compliant. The features of control system 100 enable a user to initiate a safety-critical operation of an appliance with a two-step touch process. For instance, a user may commence a safety-critical operation of oven appliance 10 in accordance with the exemplary manner described below with reference generally to FIG. 3. Specific reference may be made to FIGS. 5, 6, and 7.

Figure 5:
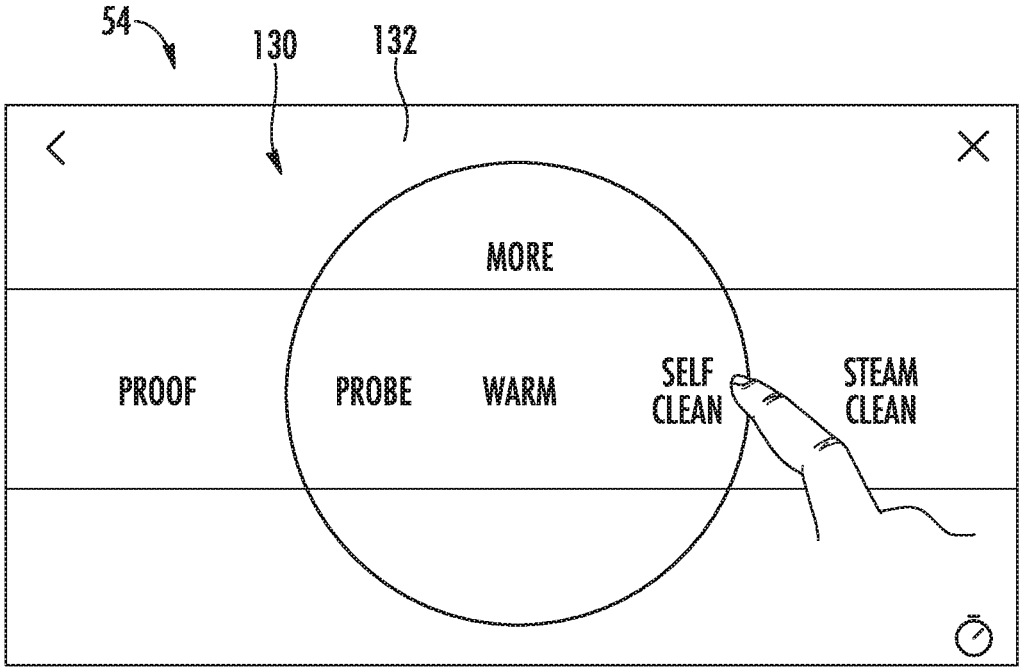
FIG. 5 provides a close up, schematic view of an exemplary touchscreen assembly of the oven appliance of FIG. 1.

FIG. 5 provides a close up, schematic view of touchscreen assembly 54 of the oven appliance 10 of FIG. 1. A user begins initiation of the safety-critical operation by providing a first touch input to touchscreen 130. As shown in FIG. 5, an initiation screen is presented to the user and various indicia are displayed. The user selects the "Self Clean" option on touchscreen 130. Touchscreen controller 140 registers or determines the location of the first touch input and sends the location to main controller 120 and microprocessor 160. Main controller 120 and microprocessor 160 each receive the location of the first touch input and determine whether the location of the first touch input corresponds with a first predetermined location.

Figure 6:
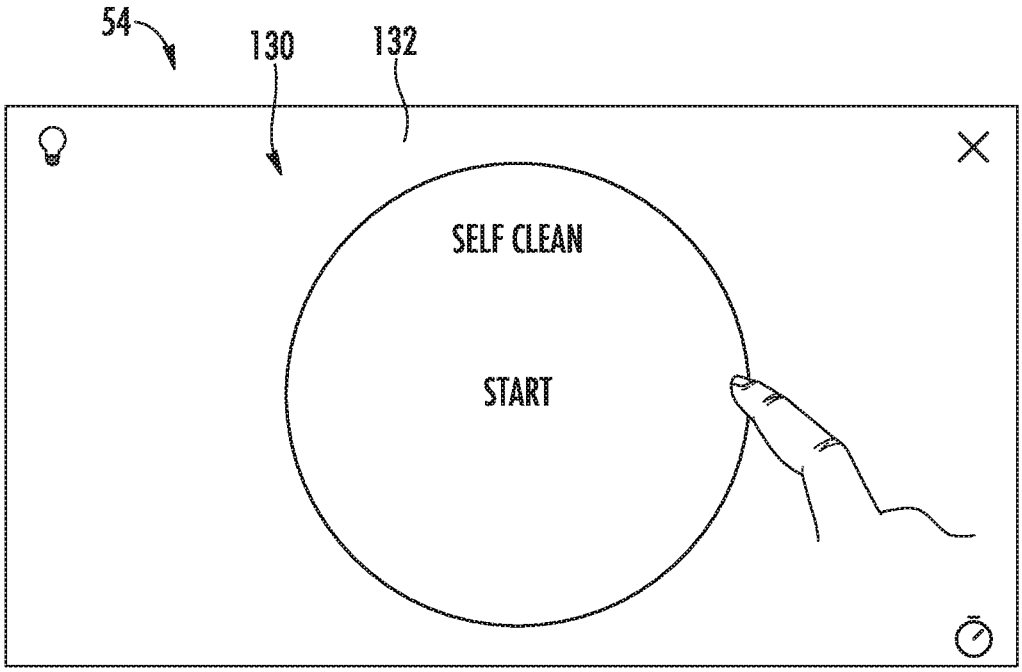
FIG. 6 provides another close up, schematic view of the touchscreen assembly of FIG. 4.

If the location of the first touch input corresponds with the first predetermined location, microprocessor 160 drives display 150 to change the screen from the initiation screen to a confirmation screen having one or more confirmation indicia for commencing the safety-critical operation. Stated differently, after microprocessor 160 determines that a user has initiated the safety-critical operation, microprocessor 160 controls display 150 to present an opportunity for the user to confirm the initiation of the safety critical operation. For instance, as shown in FIG. 6, a confirmation screen having a confirmation indicia is presented to the user. In this example, the confirmation indicia is a "Start" graphic. The changing screen and indicia make pressing the confirmation indicia intuitive to confirm initiation of the safety-critical operation.

A user confirms initiation of the safety-critical operation by providing a second touch input to touchscreen 130. As shown in FIG. 6, the user selects the "Start" option on touchscreen 130. Touchscreen controller 140 registers or determines the location of the second touch input and sends the location to main controller 120 and microprocessor 160. Main controller 120 and microprocessor 160 each receive the location of the second touch input and determine whether the location of the second touch input corresponds with a second predetermined location.

If microprocessor 160 determines that the location of the second touch input corresponds with the second predetermined location, microprocessor 160 determines that the user has confirmed the initiation of the safety-critical operation. Accordingly, microprocessor 160 sends an activation request to main controller 120. Microprocessor 160 may drive display 150 to present a cancel screen that presents a cancel indicia, e.g., so that a user may readily cancel the safety-critical operation.

If main controller 120 determines that the location of the second touch input corresponds with the second predetermined location, main controller 120 releases an interlock. The interlock is released if main controller 120 receives one or more signals from touchscreen controller 140 indicative of a location of the first touch input that corresponds with the first predetermined location and one or more signals from touchscreen controller 140 indicative of a location of the second touch input that corresponds with the second predetermined location. Stated differently, in some embodiments, touchscreen 130 must be touched in the first predetermined location and in the second predetermined location and main controller 120 must receive signals indicative of these touches to touchscreen 130 from touchscreen controller 140. In some example embodiments, main controller 120 must receive such signals sequentially (e.g., the signal indicative of the first touch input must be received before the second touch input. In some example embodiments, main controller 120 must receive the signal indicative of the second touch input within a predetermined time of receiving the signal indicative of the first touch input. In some example embodiments, main controller 120 must receive the signals sequentially and receive the signal indicative of the second touch input within a predetermined time of receiving the signal indicative of the first touch input.

In alternative embodiments, if main controller 120 determines that the location of a touch input corresponds with a predetermined location, main controller 120 releases the interlock. Particularly, in such embodiments, the interlock is released if main controller 120 receives one or more signals from touchscreen controller 140 indicative of a location of the first touch input that corresponds with the first predetermined location or one or more signals from touchscreen controller 140 indicative of a location of the second touch input that corresponds with the second predetermined location. Stated differently, in some embodiments, touchscreen 130 need only be touched in one predetermined location.

Upon receiving the activation request from microprocessor 160 and main controller 120 receives signals indicative that the location of the first touch input corresponds with the first predetermined location and the location of the second touch input corresponds with the second predetermined location associated with initiating the safety-critical operation, main controller 120 activates the one or more operational components 110 to commence the safety-critical operation. Thereafter, the appliance is operated in the safety-critical operation.

Figure 7:
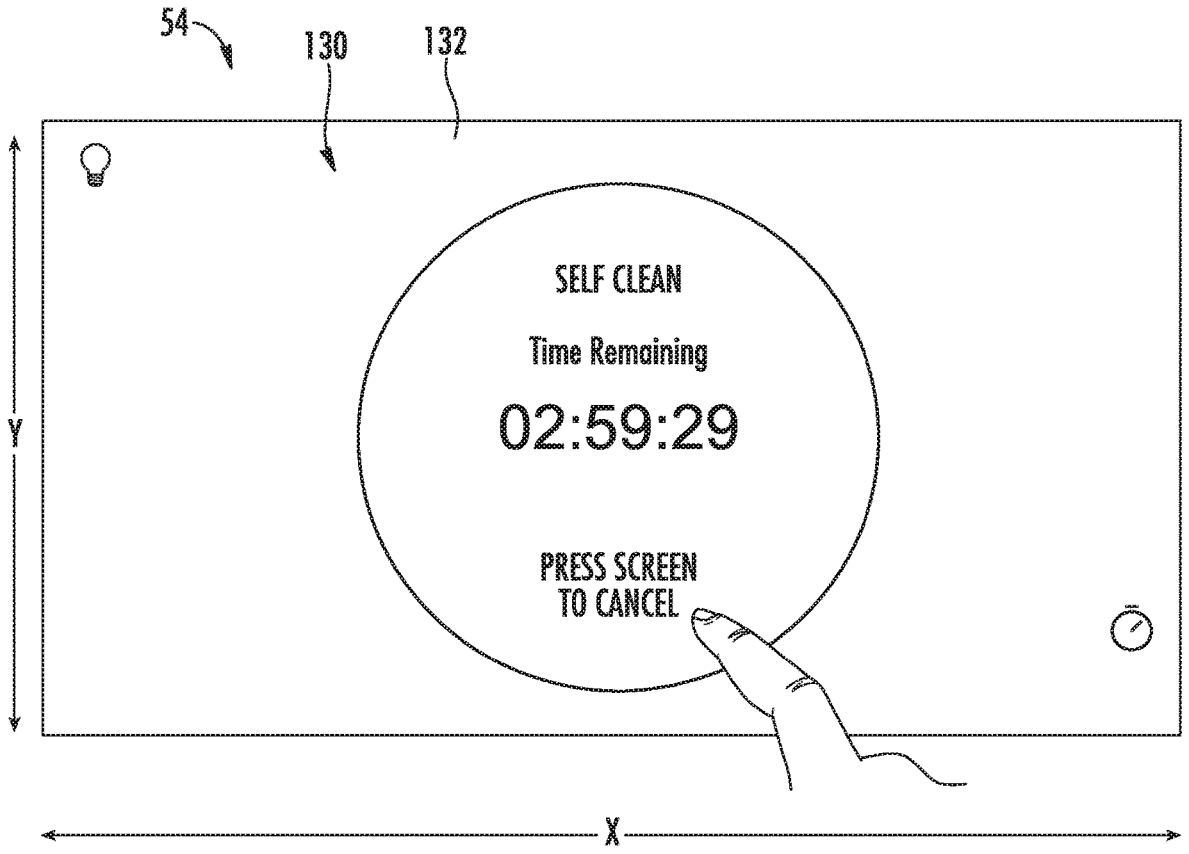
FIG. 7 provides yet another close up, schematic view of the touchscreen assembly of FIG. 4.

As shown in FIG. 7, during operation of appliance in the safety-critical operation, microprocessor 160 drives display 150 to present a cancel screen to a user. The cancel screen, in the depicted embodiment of FIG. 7, includes cancel indicia, which in this example is "Press Screen to Cancel." Should a user desire to interrupt the safety-critical operation, the user provides a cancel touch input to touchscreen 130, e.g., as shown in FIG. 7. Touchscreen 130 registers or determines the location of the cancel touch input and sends it to main controller 120. The main controller 120 receives the location from touchscreen controller 140. Thereafter, main controller 120 determines whether the location of the cancel touch input corresponds with a cancel location associated with canceling the safety-critical operation. If the location of the cancel touch input corresponds with the cancel location associated with canceling the safety-critical operation, then main controller 120 cancels the safety-critical operation. For instance, if the location of the cancel touch input corresponds with the cancel location associated with canceling the safety-critical operation, main controller 120 deactivates or terminates operation of the one or more operational components 110 performing the safety-critical operation. Further, during safety-critical operations, touchscreen controller 140 may run one or more self-tests, e.g., at predetermined intervals, to confirm the various hardware components of touchscreen controller 140, hardware of control system 100, and other critical elements are functioning properly. If any system issues or failures are detected during the self-test or if touchscreen controller 140 detects that a critical component has failed, touchscreen controller 140 may send a cancel signal to main controller 120 to cancel the safety-critical operation.

Accordingly, the safety-critical operation may be interrupted as a one-step process using a UL 60730 Class B compliant touchscreen controller 140 and meeting industry standards (e.g., UL858). Method (300) provided below further details an exemplary manner in which a user may initiate or cancel a safety-critical operation operated by an appliance.

Figure 8:
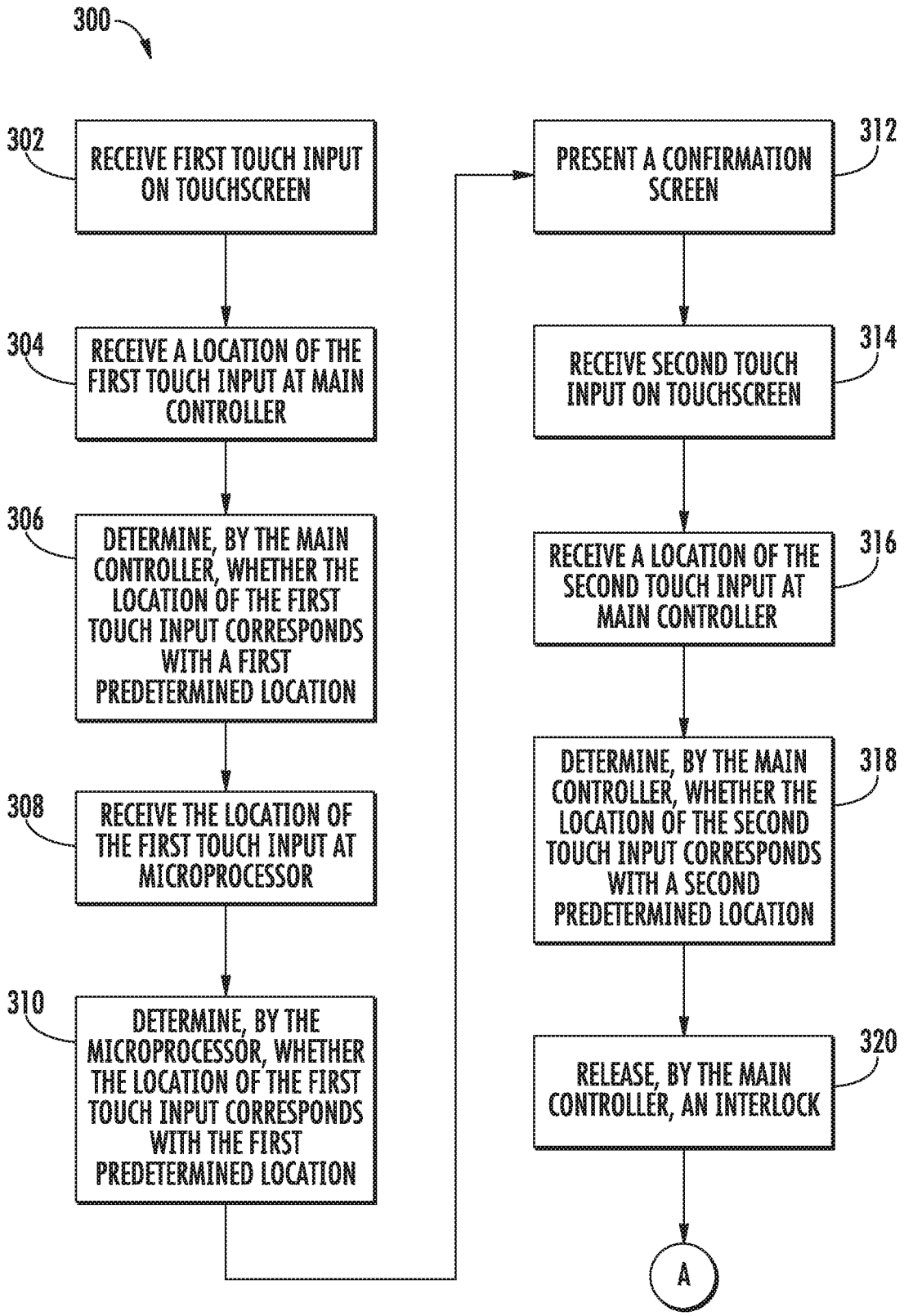
FIGS. 8 and 9 provide a flow diagram of an exemplary method for operating an appliance in a safety-critical operation.
Figure 9:
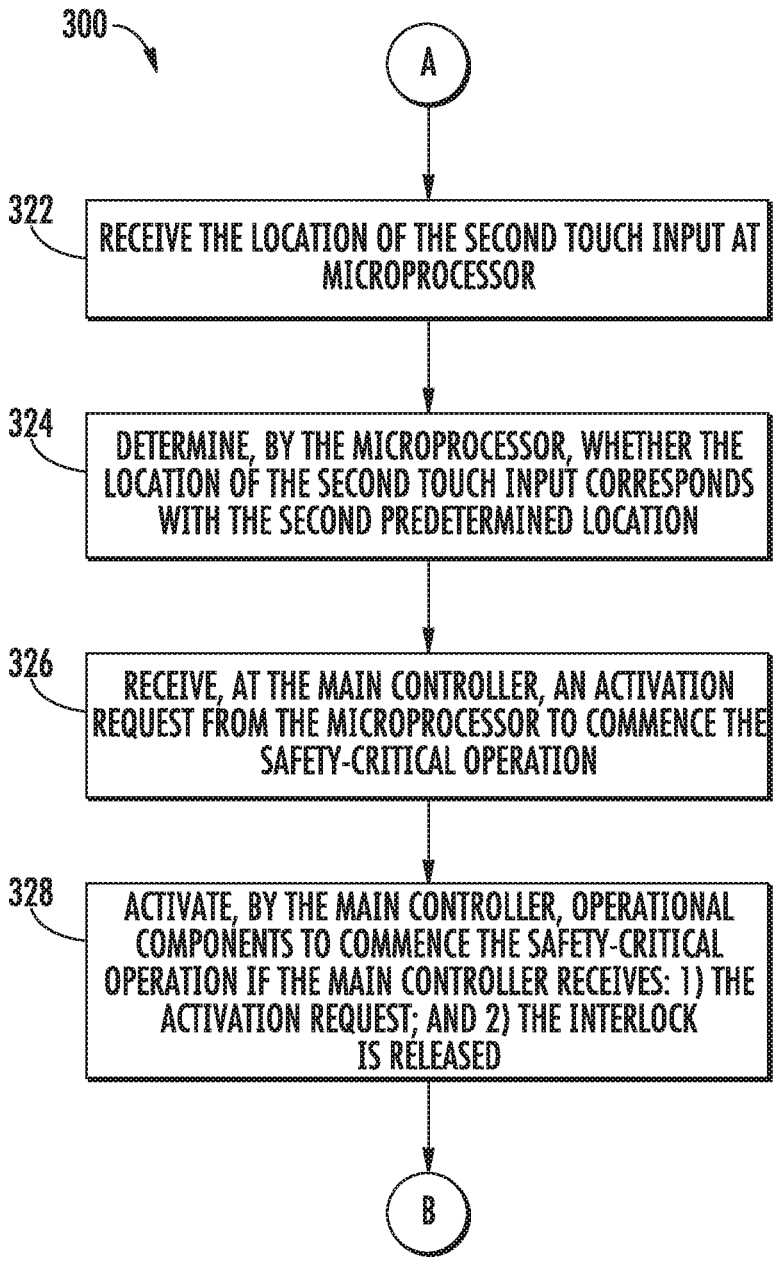

FIGS. 8 and 9 provide a flow diagram of an exemplary method (300) for operating an appliance in a safety-critical operation. For instance, method (300) may be utilized to operate an oven appliance in a self-cleaning cycle, such as e.g., the oven appliance 10 of FIGS. 1 and 2. Portions of method (300) may be implemented by control system 100 depicted in FIG. 3 and described in the accompanying text or by any other suitable device or component. Accordingly, reference numerals used to describe and illustrate the features of oven appliance 10 of FIGS. 1 and 2 and control system 100 of FIG. 3 will be utilized below to provide context to method (300).

At (302), method (300) includes receiving, on a touchscreen of a touchscreen assembly, a first touch input. For instance, touchscreen may be touchscreen 130 of touchscreen assembly 54. In FIG. 5, an initiation screen is shown on touchscreen 130 and a user is shown providing a first touch input to touchscreen 130 of touchscreen assembly 54. As shown, the first touch input is provided in the appropriate touch region to begin initiation of the safety-critical operation, which in this example is a self-cleaning cycle of oven appliance 10. The touch region may be defined about the perimeter of the illuminated text "Self Clean," for example.

At (304), method (300) includes receiving, by a main controller communicatively coupled with a microprocessor and a touchscreen controller, a location of the first touch input on the touchscreen from the touchscreen controller. Upon receiving the first touch input at (302), touchscreen controller 140 determines or registers the location of the first touch input to touchscreen 130, e.g., by processing the electrical pulses generated when one or more of the driving lines 142 being pressed into one or more of the sensing lines 146. For example, the location may be registered as an X-Y coordinate. The location of the first touch input is sent to microprocessor 160 and main controller 120. Thus, main controller 120 receives the location of the first touch input on touchscreen 130 from touchscreen controller 140.

At (306), method (300) includes determining, by the main controller, whether the location of the first touch input corresponds with a first predetermined location associated with initiating the safety-critical operation. For instance, upon receiving the location of the first touch input from touchscreen controller 140 at (304), main controller 120 compares the location of the first touch input with the first predetermined location. The first predetermined location, e.g., an X-Y coordinate on touchscreen 130, is a location associated with initiating the safety-critical operation. For instance, the first predetermined location may be a location defined about the perimeter of the Self-Clean indicia depicted in FIG. 5. Thus, if a user touches a location within this region of touchscreen 130, then the location of the first touch input corresponds with the first predetermined location, and consequently, the user has touched the correct location on touchscreen 130 to begin initiation of the safety-critical operation, e.g., the self-clean cycle.

At (308), method (300) includes receiving, by a microprocessor communicatively coupled with the main controller and a display of the touchscreen assembly, the location of the first touch input on the touchscreen from the touchscreen controller. As noted above, upon receiving the first touch input at (302), touchscreen controller 140 determines or registers the location of the first touch input to touchscreen 130, e.g., by processing the electrical pulses generated when one or more of the driving lines 142 being pressed into one or more of the sensing lines 146. The location of the first touch input is sent to microprocessor 160 and main controller 120. Thus, microprocessor 160 receives the location of the first touch input on touchscreen 130 from touchscreen controller 140. Microprocessor 160 may receive the location of the first touch input and main controller 120 may receive the location of the first touch input simultaneously or nearly simultaneously.

At (310), method (300) includes determining, by the microprocessor, whether the location of the first touch input corresponds with the first predetermined location associated with initiating the safety-critical operation. For instance, upon receiving the location of the first touch input from touchscreen controller 140 at (308), microprocessor 160 compares the location of the first touch input with the first predetermined location, e.g., in a similar fashion that main controller 120 compares the location of the first touch input with the first predetermined location at (306). If a user touches a location of touchscreen 130 that corresponds with the first predetermined location, the user has touched the correct location on touchscreen 130 to continue the initiation of the safety-critical operation.

At (312), in some implementations, method (300) includes presenting, at the display, a confirmation screen having a confirmation indicia if the microprocessor determines that the location of the first touch input corresponds with the first location associated with initiating the safety-critical operation. Stated differently, after a user has correctly provided a touch input at the first predetermined location and microprocessor has determined that the touch input was provided at the first predetermined location, microprocessor 160 drives display 150 to change the graphics or indicia from the initiation screen shown in FIG. 5 to the confirmation screen shown in FIG. 6. As shown in FIG. 6, the confirmation screen has a confirmation indicia, e.g., "Start," in which a user may touch to continue initiating the safety-critical process. In alternative exemplary implementations, the confirmation indicia is located on touchscreen 130 on the first or initiation screen.

At (314), method (300) includes receiving, on the touchscreen, a second touch input. For instance, as shown in FIG. 6, a confirmation screen is shown on touchscreen 130 and a user is shown providing a second touch input to touchscreen 130. As shown, the first touch input is provided in the appropriate touch region to confirm initiation of the safety-critical operation. The touch region may be defined about the perimeter of the illuminated confirmation indicia "Start," for example.

At (316), method (300) includes receiving, by the main controller, a location of the second touch input on the touchscreen from the touchscreen controller. Similar to (304), at (316), upon receiving the second touch input at (314), touchscreen controller 140 determines or registers the location (e.g., an X-Y coordinate) of the second touch input to touchscreen 130, e.g., by processing the electrical pulses generated when one or more of the driving lines 142 being pressed into one or more of the sensing lines 146. The location of the second touch input is sent to microprocessor 160 and main controller 120. Thus, main controller 120 receives the location of the second touch input on touchscreen 130 from touchscreen controller 140.

At (318), method (300) includes determining, by the main controller, whether the location of the second touch input corresponds with a second predetermined location associated with initiating the safety-critical operation. Upon receiving the location of the second touch input from touchscreen controller 140 at (316), main controller 120 compares the location of the second touch input with the second predetermined location. The second predetermined location, e.g., an X-Y coordinate on touchscreen 130, is a location associated with initiating the safety-critical operation. For instance, the second predetermined location may be a location defined about the perimeter of the "Start" confirmation indicia depicted in FIG. 6. Thus, if a user touches a location within this region of touchscreen 130, then the location of the second touch input corresponds with the second predetermined location, and therefore, the user has touched the correct location on touchscreen 130 to confirm initiation of the safety-critical operation.

At (320), method (300) includes releasing, by the main controller, an interlock if the main controller determines that the location of the first touch input corresponds with the first location and the location of the second touch input corresponds with the second location associated with initiating the safety-critical operation. For this exemplary implementation, main controller 120 includes an interlock, and to release the interlock, the main controller 120 is required to: (1) receive one or more signals from touchscreen controller 140 indicative that touchscreen 130 was touched in a location that corresponds with the first predetermined location as determined by main controller 120; and (2) receive one or more signals from touchscreen controller 140 indicative that touchscreen 130 was touched in a location that corresponds with the second predetermined location as determined by main controller 120.

In some implementations, to release the interlock, main controller 120 must receive such signals sequentially or in order. That is, in such implementations, main controller 120 must first receive one or more signals from touchscreen controller 140 indicative that touchscreen 130 was touched in a location that corresponds with the first predetermined location and then must receive one or more signals from touchscreen controller 140 indicative that touchscreen 130 was touched in a location that corresponds with the second predetermined location.

Further, in some implementations, to release the interlock, the interlock is not released by main controller 120 unless main controller 120 receives the location of the second touch input on touchscreen 130 from touchscreen controller 140 within a predetermined time of receiving the location of the first touch input on touchscreen 130 from touchscreen controller 140. For instance, in some implementations, the predetermined time is less than or equal to thirty (30) seconds.

In yet other implementations, at (320), method (300) includes releasing, by the main controller, an interlock if the main controller determines that the location of the first touch input corresponds with the first location or the location of the second touch input corresponds with the second location associated with initiating the safety-critical operation. Thus, in such implementations, the interlock is released if main controller 120 receives one or more signals from touchscreen controller 140 indicative of a location of the first touch input that corresponds with the first predetermined location or one or more signals from touchscreen controller 140 indicative of a location of the second touch input that corresponds with the second predetermined location. Stated differently, in some implementations, touchscreen 130 need only be touched in one predetermined location.

At (322), method (300) includes receiving, by the microprocessor, the location of the second touch input on the touchscreen from the touchscreen controller. As noted previously, upon receiving the second touch input at (314), touchscreen controller 140 determines or registers the location of the second touch input to touchscreen 130, e.g., by processing the electrical pulses generated when one or more of the driving lines 142 being pressed into one or more of the sensing lines 146. The location of the second touch input is sent to microprocessor 160 and main controller 120. Thus, microprocessor 160 receives the location of the second touch input on touchscreen 130 from touchscreen controller 140. Microprocessor 160 may receive the location of the second touch input and main controller 120 may receive the location of the second touch input simultaneously or nearly simultaneously.

At (324), method (300) includes determining, by the microprocessor, whether the location of the second touch input corresponds with the second predetermined location associated with initiating the safety-critical operation. For instance, upon receiving the location of the second touch input from touchscreen controller 140 at (322), microprocessor 160 compares the location of the second touch input with the second predetermined location, e.g., in a similar fashion that main controller 120 compares the location of the second touch input with the second predetermined location at (318). If a user touches a location of touchscreen 130 that corresponds with the second predetermined location, the user has touched the correct location on touchscreen 130 to confirm the initiation of the safety-critical operation.

At (326), method (300) includes receiving, at the main controller, an activation request from the microprocessor to commence the safety-critical operation if the location of the first touch input corresponds with the first predetermined location and the location of the second touch input corresponds with the second predetermined location associated with initiating the safety-critical operation. Upon determining that the location of the first touch input corresponds with the first predetermined location at (310) and that the location of the second touch input corresponds with the second predetermined location at (324), microprocessor 160 determines that the user desires to commence the safety-critical operation. Accordingly, microprocessor 160 sends the activation signal to main controller 120. Main controller 120 receives the activation signal from the microprocessor 160 to commence the safety-critical operation.

At (328), method (300) includes activating, by the main controller, one or more operational components to commence the safety-critical operation if the main controller receives the activation request and the interlock is released. Upon receiving the activation request at (326) and releasing the interlock at (320), main controller 120 activates one or more operational components 110 of the appliance. For instance, if the appliance is oven appliance 10 and the safety-critical operation is a self-cleaning cycle, main controller 120 activates one or both of heating elements 40, 42, e.g., to perform the self-cleaning cycle.

In some implementations of method (300), prior to main controller 120 activating the one or more operational components 110 to operate the oven appliance 10 in the safety-critical operation, touchscreen controller 140 performs a self-test operation of the hardware and critical functions of touchscreen controller 140 and various other components of control system 100. If no critical issues are found by touchscreen controller 140 during the self-test operation, touchscreen controller 140 sends a self-test confirmation signal to main controller 120. Upon receiving the self-test confirmation from touchscreen controller 140, main controller 120 activates the one or more operational components 110 to operate the oven appliance 10 in the safety-critical operation.

Figure 10:
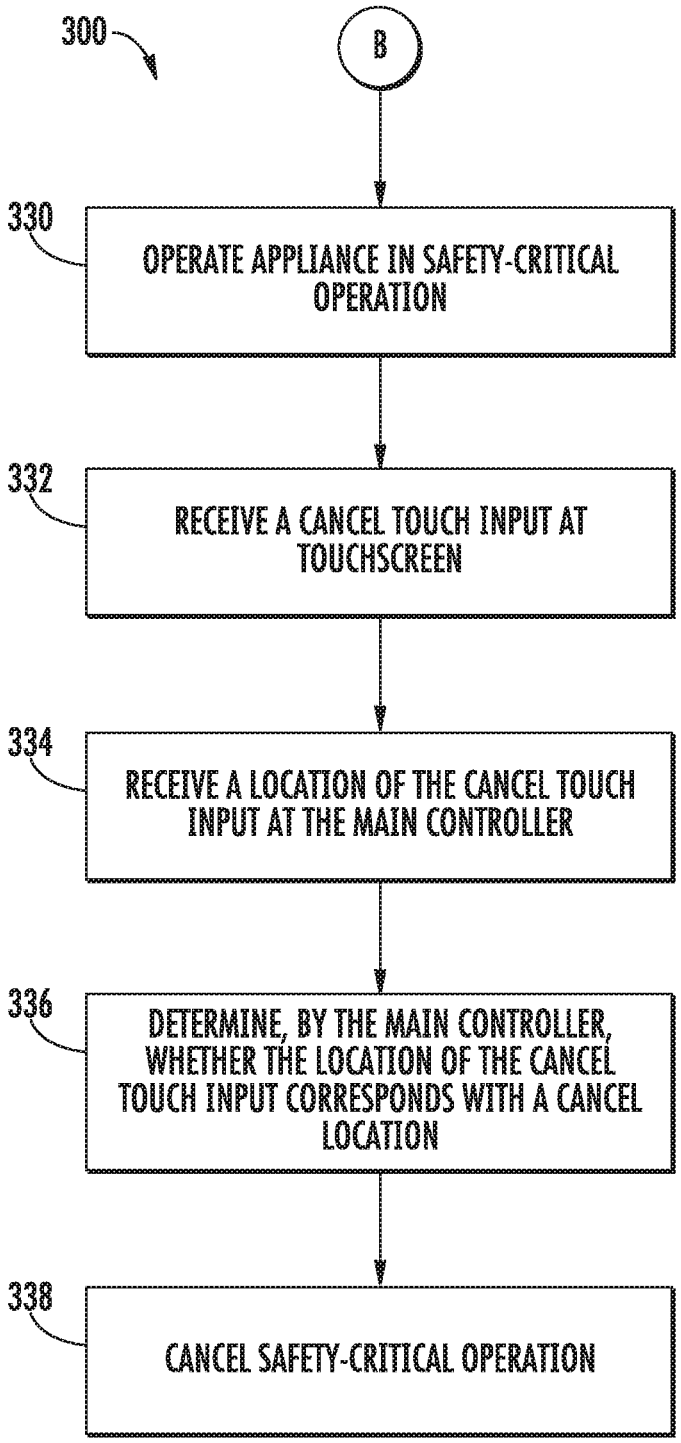
FIG. 10 provides a flow diagram of an exemplary method for canceling an appliance performing a safety-critical operation.

FIG. 10 provides a flow diagram of an exemplary implementation of method (300) for canceling an appliance performing a safety-critical operation.

At (330), after activating the one or more operational components to operate the appliance in the safety-critical operation at (328), method (300) includes operating the appliance in the safety-critical operation for a predetermined run time. As noted above, the safety-critical operation may be a self-cleaning cycle, for example. The predetermined run time may be three (3) hours, four (4) hours, five (5) hours, etc.

At (332), method (300) includes receiving, during operating the appliance in the safety-critical operation for the predetermined run time, a cancel touch input to the touchscreen. In some implementations, method (300) includes presenting, at the display, a cancel screen having a cancel indicia. For instance, as shown in FIG. 7, during operation of appliance in the safety-critical operation, microprocessor 160 drives display 150 to present a cancel screen to a user. The cancel screen, in the depicted embodiment of FIG. 7, includes the name of the safety-critical cycle, "Self Clean," the time remaining on the cycle, and cancel indicia, which in this example is "Press Screen to Cancel." Should a user desire to interrupt the safety-critical operation, the user provides the cancel touch input to touchscreen 130. When the user provides the cancel touch input to touchscreen 130 during operation of the appliance in the safety-critical operation, e.g., as shown in FIG. 7, touchscreen controller 140 registers or determines the location of the cancel touch input, e.g., so that it may be forwarded to main controller 120 and microprocessor 160.

At (334), method (300) includes receiving, by the main controller from the touchscreen controller, a location of the cancel touch input on the touchscreen. Upon receiving the cancel touch input at (332), touchscreen controller 140 determines or registers the location of the cancel touch input to touchscreen 130, e.g., by processing the electrical pulses generated when one or more of the driving lines 142 being pressed into one or more of the sensing lines 146. For example, the location may be registered as an X-Y coordinate. The location of the cancel touch input is sent to microprocessor 160 and main controller 120. Thus, main controller 120 receives the location of the cancel touch input on touchscreen 130 from touchscreen controller 140. Microprocessor 160 may receive the cancel touch input, e.g., to drive the display to present new or additional indicia.

At (336), method (300) includes determining, by the main controller, whether the location of the cancel touch input corresponds with a cancel location associated with canceling the safety-critical operation. For instance, upon receiving the location of the cancel touch input from touchscreen controller 140 at (334), main controller 120 compares the location of the cancel touch input with the cancel location, which may be a predetermined location on touchscreen 130. The cancel location, e.g., an X-Y coordinate on touchscreen 130, is a location associated with canceling the safety-critical operation. For instance, the cancel location may be a location defined about the perimeter of the "Cancel" indicia depicted in FIG. 7. Thus, if a user touches a location within this region of touchscreen 130, then the location of the cancel touch input corresponds with the cancel location, and consequently, the user has touched the correct location on touchscreen 130 to cancel the safety-critical operation.

In some exemplary implementations, touchscreen 130 defines an area. For instance, the area of touchscreen 130 may be the length of touchscreen 130 along the X-axis multiplied by the length of touchscreen 130 along the Y-axis, e.g., as shown in FIG. 7. In such implementations, the cancel location is any location of the area of the touchscreen. In this way, a user may touch any portion of touchscreen 130 to cancel the safety-critical operation. This may, for example, be particularly advantageous if a backlight of display 150 burns out while the safety-critical operation is being performed and the user desires to cancel the operation.

At (338), method (300) includes canceling, at the main controller, the safety-critical operation if the location of the cancel touch input corresponds with the cancel location associated with canceling the safety-critical operation. For instance, if the location of the cancel touch input corresponds with the cancel location associated with canceling the safety-critical operation, main controller 120 deactivates or terminates operation of the one or more operational components 110 performing the safety-critical operation. Accordingly, the user may interrupt the safety-critical operation as a one-step process.

In some implementations, during operating the appliance in the safety-critical operation for the predetermined run time, method (300) further includes performing, by the touchscreen controller, a self-test operation at predetermined intervals, e.g., every ten (10) minutes. If one or more system issues are detected by the touchscreen controller during one of the self-test operations, method (300) may further include canceling, automatically, the safety-critical operation. The operation is canceled automatically in that no user input is required to cancel the cycle if one or more system issues are detected.

This written description uses examples to disclose the invention, including the best mode, and to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An appliance, comprising:

one or more operational components configured to perform a safety-critical operation;

a control system for operating the appliance in the safety-critical operation, the control system comprising:

a main controller;

a touchscreen assembly, comprising;

a touchscreen configured for receiving touch inputs to the touchscreen;

a touchscreen controller communicatively coupled with the main controller and configured to detect a location of the touch inputs to the touchscreen;

a display for presenting one or more indicia;

a microprocessor communicatively coupled with the main controller, the touchscreen controller, and the display, the microprocessor configured to drive the one or more indicia of the display;

wherein the main controller is configured to:

receive, from the touchscreen controller and in response to a touch input to the touchscreen, a location of the touch input to the touchscreen;

determine whether the location of the touch input corresponds with a predetermined location associated with initiating the safety-critical operation;

receive, from the microprocessor, an activation request to commence the safety-critical operation; and activate the one or more operational components to commence the safety-critical operation if the main controller receives the activation request and the location of the touch input corresponds with the predetermined location.

2. The appliance of claim 1, wherein the touch input is a first touch input and the predetermined location is a first predetermined location, and wherein the microprocessor is configured to:

receive, from the touchscreen controller and in response to the first touch input to the touchscreen, the location of the first touch input to the touchscreen;

determine whether the location of the first touch input corresponds with the first predetermined location associated with initiating the safety-critical operation;

receive, from the touchscreen controller and in response to a second touch input to the touchscreen, a location of the second touch input to the touchscreen; and determine whether the location of the second touch input corresponds with a second predetermined location associated with initiating the safety-critical operation;

wherein if the location of the first touch input corresponds with the first location and the location of the second touch input corresponds with the second location associated with initiating the safety-critical operation, then the microprocessor sends the activation request to the main controller to commence the safety-critical operation.

3. The appliance of claim 2, wherein if the microprocessor determines that the location of the first touch input corresponds with the first predetermined location associated with initiating the safety-critical operation, the microprocessor is further configured to:

drive the display to present a confirmation screen having a confirmation indicia for commencing the safety-critical operation.

4. The appliance of claim 2, wherein the microprocessor must receive the location of the second touch input to the touchscreen within a predetermined time of receiving the location of the first touch input to the touchscreen in order to send the activation request to the main controller.

5. The appliance of claim 2, wherein the touchscreen controller is configured to:

determine the location of the first touch input to the touchscreen;

send the location of the first touch input to the microprocessor and the main controller;

determine the location of the second touch input to the touchscreen; and send the location of the second touch input to the microprocessor and the main controller.

6. The appliance of claim 1, wherein the touchscreen controller is UL 60730 Class B compliant.

7. The appliance of claim 1, wherein when the appliance is operated in the safety-critical operation for a predetermined run time, the main controller is further configured to:

receive, from the touchscreen controller, a location of a cancel touch input to the touchscreen;

determine whether the location of the cancel touch input corresponds with a cancel location associated with canceling the safety-critical operation; and deactivate the one or more operational components to cancel the safety-critical operation if the location of the cancel touch input corresponds with the cancel location associated with canceling the safety-critical operation.

8. The appliance of claim 7, wherein the touchscreen defines an area, and wherein the cancel location is any location of the area of the touchscreen.

9. The appliance of claim 1, wherein when the appliance is operated in the safety-critical operation for a predetermined run time, the microprocessor is further configured to:

drive the display to present a cancel screen having a cancel indicia for canceling the safety-critical operation.

10. The appliance of claim 1, wherein the appliance is an oven appliance and the safety-critical operation is a self-cleaning cycle.

11. The appliance of claim 10, wherein the oven appliance comprises a cabinet defining an oven cavity, and wherein the one or more operational components comprise a heat element disposed within the oven cavity.

12. An appliance, comprising:

one or more operational components configured to perform a safety-critical operation;

a control system for operating the appliance in the safety-critical operation, the control system comprising:

a main controller;

a touchscreen configured for receiving one or more touch inputs to the touchscreen;

a touchscreen controller communicatively coupled with the main controller and configured to detect the one or more touch inputs to the touchscreen, wherein the touchscreen controller is UL 60730 Class B compliant;

a display for presenting one or more indicia;

a microprocessor communicatively coupled with the main controller, the touchscreen controller, and the display, the microprocessor configured to drive the one or more indicia of the display;

wherein the main controller is configured to:

operate the appliance in the safety-critical operation for a predetermined run time;

receive, during operation of the appliance in the safety-critical operation for the predetermined run time, a cancel touch input to any location on the touchscreen from the touchscreen controller; and cancel the safety-critical operation based on the cancel touch input on the touchscreen.

* * * * *